US009359569B2

(12) United States Patent
Nakagawa et al.

(10) Patent No.: US 9,359,569 B2
(45) Date of Patent: Jun. 7, 2016

(54) METHOD FOR DEACTIVATING COAL

(71) Applicant: MITSUBISHI HEAVY INDUSTRIES, LTD., Tokyo (JP)

(72) Inventors: Keiichi Nakagawa, Tokyo (JP); Setsuo Omoto, Tokyo (JP); Junji Asahara, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 92 days.

(21) Appl. No.: 14/367,805

(22) PCT Filed: Dec. 21, 2012

(86) PCT No.: PCT/JP2012/083231
§ 371 (c)(1),
(2) Date: Jun. 20, 2014

(87) PCT Pub. No.: WO2013/103097
PCT Pub. Date: Jul. 11, 2013

(65) Prior Publication Data

US 2014/0345193 A1 Nov. 27, 2014

(30) Foreign Application Priority Data

Jan. 6, 2012 (JP) ..... 2012-000941

(51) Int. Cl.

| | |
|---|---|
| ***C10L 5/02*** | (2006.01) |
| ***C10L 5/28*** | (2006.01) |
| ***C10L 9/06*** | (2006.01) |
| ***C10L 9/08*** | (2006.01) |

(Continued)

(52) U.S. Cl.
CPC ... *C10L 5/26* (2013.01); *C10L 5/04* (2013.01); *C10L 9/06* (2013.01); *C10L 9/08* (2013.01); *C10L 2290/08* (2013.01)

(58) Field of Classification Search
CPC ..... C10L 5/26; C10L 5/04; C10L 9/08; C10L 9/06; C10L 2290/08
USPC ..... 44/530, 550, 591, 592, 593, 596, 597, 44/599, 620, 621, 625
See application file for complete search history.

(56) References Cited

U.S. PATENT DOCUMENTS 4,199,325 A * 4/1980 Smith ..... C10L 9/00 206/106
4,402,706 A 9/1983 Wunderlich (Continued)

FOREIGN PATENT DOCUMENTS

EP 0 758 677 A1 2/1997
JP 59-074189 A 4/1984

(Continued)

OTHER PUBLICATIONS

Chapter 1 Size and Properties Particles Principles of Gas Solid Flows by Liang Shih Fan and Chao Zhu (1998 Print and Oct. 2009 online 9780511530142).*

(Continued)

*Primary Examiner* — Pamela H Weiss
(74) *Attorney, Agent, or Firm* — Westerman, Hattori, Daniels & Adrian, LLP

(57) ABSTRACT

A method for deactivating coal, in which coal is deactivated with a treatment gas containing oxygen, wherein a deactivation step for deactivating the coal in a temperature range 45-70° C. is carried out.

1 Claim, 3 Drawing Sheets

(51) Int. Cl.
*C10L 5/26* (2006.01)
*C10L 5/04* (2006.01)

(56) References Cited

U.S. PATENT DOCUMENTS

| | | | | | |
|---|---|---|---|---|---|
| 4,412,839 | A | | 11/1983 | Taylor | |
| 5,601,692 | A | | 2/1997 | Rinker et al. | |
| 5,863,304 | A | * | 1/1999 | Viall | C10L 9/06 44/620 |
| 6,146,432 | A | * | 11/2000 | Ochs | C10L 5/00 44/501 |

FOREIGN PATENT DOCUMENTS

| | | | |
|---|---|---|---|
| JP | 59-227979 | A | 12/1984 |
| JP | 60-065097 | A | 4/1985 |
| JP | 1-116048 | A | 5/1989 |
| JP | 5-255676 | A | 10/1993 |
| JP | 9-157671 | A | 6/1997 |
| JP | 2011-037938 | A | 2/2011 |
| WO | 2011/016371 | A1 | 2/2011 |

OTHER PUBLICATIONS

Machine Translation JP 2011-037938A.*

Chinese Office Action dated Nov. 3, 2014, issued in Chinese Application No. 201280049589.3; w/English translation. (13 pages).

International Search Report (Form PCT/ISA/210) of International Application No. PCT/JP2012/083231 mailed Jan. 22, 2013 with Forms PCT/ISA/220 and PCT/ISA/237 with English translation (14 pages).

Notification of Transmittal of Translation of the International Preliminary Report (Form PCT/IB/338) of International Application No. PCT/JP2012/083231 mailed Jul. 17, 2014 with Form PCT/IB/373 (2 pages).

Japanese Office Action dated Dec. 10, 2013, issued in corresponding JP application No. 2012-000941 with English translation (7 pages).

Office Action dated Jun. 11, 2015, issued in counterpart Australian Patent Application No. 2012364054 (5 pages).

Office Action dated Feb. 16, 2016, issued in counterpart German Patent Application No. 11 2012 005 588.8, with English translation (9 pages).

* cited by examiner

METHOD FOR DEACTIVATING COAL

TECHNICAL FIELD

The present invention relates to a coal deactivation processing method in which coal is deactivated with processing gas containing oxygen.

BACKGROUND ART

Pyrolized coal has an activated surface and tends to bond with oxygen. Accordingly, when the coal is stored as it is, heat generated by reaction with oxygen in air may cause the coal to spontaneously combust. In view of this, for example, in Patent Literatures 1, 2 listed below and the like, coal subjected to pyrolysis (300° C. to 500° C.) is cooled and then subjected to coal deactivation processing in which oxygen is adsorbed to the coal by exposing the coal to a processing gas atmosphere (100° C. to 200° C.) containing oxygen. Spontaneous combustion of upgraded coal in storage can be thus prevented.

CITATION LIST

Patent Literatures

Patent Literature 1: Japanese Patent Application Publication No. Sho 59-074189

Patent Literature 2: Japanese Patent Application Publication No. Sho 60-065097

SUMMARY OF INVENTION

Technical Problem

When the deactivation processing of the upgraded coal is performed as described in Patent Literatures 1, 2 and the like, the upgraded coal is deactivated in such a way that more oxygen is first adsorbed to a surface portion of the coal than to an internal portion thereof. Accordingly, the deactivation processing of Patent Literatures 1, 2 and the like has a problem that, when the deactivation processing is terminated at a stage where a necessary and sufficient amount of oxygen is adsorbed to the surface portion of the coal, the coal may spontaneously combust if the coal breaks due to impact or the like and the internal portion of the coal is exposed to the outside. Meanwhile, when the deactivation processing is performed in such a way that the necessary and sufficient amount of oxygen is adsorbed also to the internal portion of the coal, a more than necessary amount of oxygen is adsorbed to the surface portion of the coal and the combustion heating value per unit weight of the coal is greatly reduced.

In view of this, an object of the present invention is to provide a coal deactivation processing method capable of suppressing reduction of the combustion heating value per unit weight of the coal while preventing spontaneous combustion of the coal.

Solution to Problem

A coal deactivation processing method of a first aspect of the invention to solve the problem described above is a coal deactivation processing method in which coal is deactivated with processing gas containing oxygen, characterized in that the method comprises subjecting the coal to deactivation processing within a temperature range of 45° C. to 70° C.

A coal deactivation processing method of a second aspect of the invention is the coal deactivation processing method of the first aspect of the invention characterized in that the coal is subjected to the deactivation processing after the coal is compression-molded in such a way that the compression-molded coal has a surface area equivalent sphere diameter R, which is expressed by formula (1), of 5 mm to 50 mm, $$R=6\times(V/A) \quad (1)$$

where V represents a coal particle volume and A represents a coal particle external surface area.

A coal deactivation processing method of a third aspect of the invention is the coal deactivation processing method of the first or second aspect of the invention characterized in that the coal is pyrolized coal.

Advantageous Effects of Invention

In the coal deactivation processing method of the present invention, the amount of oxygen adsorbed to a surface portion of the coal per unit time (adsorption rate) is smaller (slower) than that in a conventional technique and oxygen enters an internal portion of the coal and is adsorbed thereto in an earlier stage than in the conventional technique. Accordingly, a difference in the oxygen adsorption amount between the surface portion and the internal portion of the coal is much smaller than that in the conventional technique. As a result, it is possible to suppress reduction of a combustion heating value per unit weight of the coal while preventing spontaneous combustion of the coal.

DESCRIPTION OF EMBODIMENTS

Embodiments of a coal deactivation processing method of the present invention are described based on the drawings. However, the present invention is not limited to the embodiments described below based on the drawings.

First Embodiment

Figure 1:
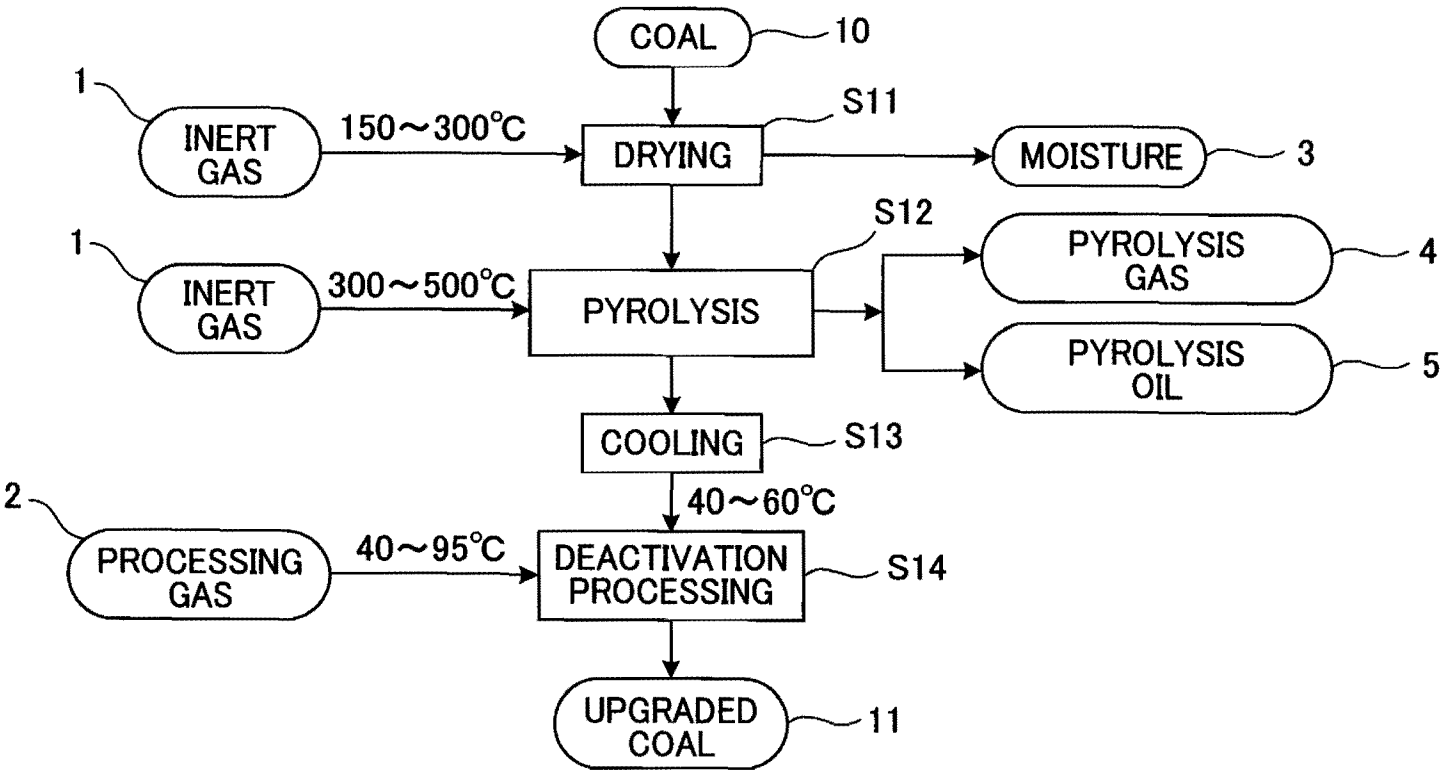
FIG. 1 is a flow diagram of a first embodiment of a coal upgrading method using a coal deactivation processing method of the present invention.
Figure 2:
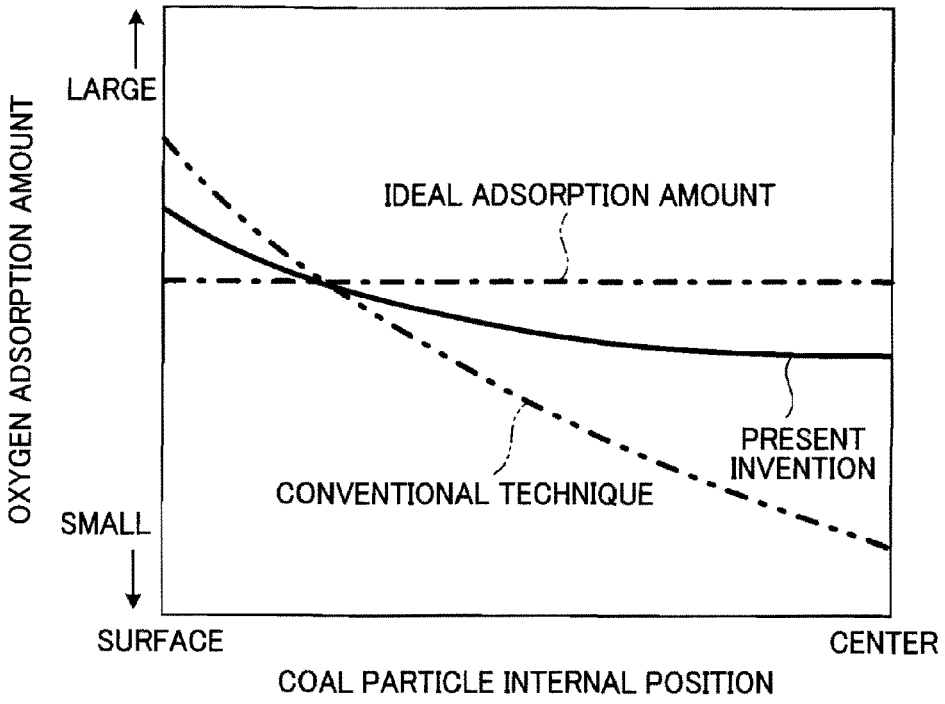
FIG. 2 is a graph showing oxygen adsorption amounts in internal positions of coal particles subjected to the deactivation processing.

A first embodiment of a coal upgrading method using a coal deactivation processing method of the present invention is described based on FIGS. 1 and 2.

As shown in FIG. 1, first, low-grade coal 10 with high water content such as brown coal and sub-bituminous coal is heated (about 150° C. to about 300° C.) in an atmosphere of inert gas 1 such as nitrogen gas to cause moisture 3 to evaporate from the coal 10 and is thereby dried (drying step S11). Then, the coal 10 is further heated (about 300° C. to about 500° C.) in the atmosphere of the inert gas 1 to remove pyrolysis gas 4 of a low-boiling-point component and pyrolysis oil 5 of a high-boiling-point component from the coal 10 through distillation (pyrolysis step S12).

After being cooled (about 40° C. to about 60° C.) (cooling step S13), the pyrolized coal 10 is subjected to heat treatment (40° C. to 95° C. (preferably 45° C. to 70° C.) in an atmosphere of processing gas 2 (for example, gas whose oxygen concentration is adjusted to be about 5% to about 10% by mixing nitrogen to air) containing oxygen and is thereby turned into upgraded coal 11 (deactivation processing step S14).

Here, since a heat treatment temperature in the deactivation processing (40° C. to 95° C. (preferably 45° C. to 70° C.)) is lower than that in a conventional technique (100° C. to 200° C.), the amount of oxygen adsorbed to a surface portion of the coal 10 per unit time (adsorption rate) is smaller (slower) than that in the conventional technique and a large amount of oxygen enters an internal portion of the coal 10 and is adsorbed thereto in an earlier stage than in the conventional technique.

Accordingly, in the coal 10, the oxygen adsorption amount per unit time (oxygen adsorption rate) in the surface portion is lower than that in the conventional technique while the oxygen adsorption amount per unit time in the internal portion is higher than that in the conventional technique. Hence, in the upgraded coal 11 subjected to the deactivation processing, a difference in the oxygen adsorption amount between the surface portion and the internal portion is much smaller than that in the conventional technique (see FIG. 2).

Accordingly, the coal deactivation processing method of the embodiment can suppress reduction of a combustion heating value of per unit weight the upgraded coal 11 while preventing spontaneous combustion of the upgraded coal 11.

Moreover, since the heat treatment temperature in the deactivation processing (40° C. to 95° C. (preferably 45° C. to 70° C.)) is lower than that in the conventional technique (100° C. to 200° C.), the amount of the upgraded coal 11 combusted in the deactivation processing can be reduced compared to that in the conventional technique. Accordingly, the production amount of the upgraded coal 11 can be improved compared to that in the conventional technique.

Note that, when the heat treatment temperature in the deactivation processing exceeds 95° C., it is difficult to suppress reduction of the combustion heating value of per unit weight the upgraded coal 11 while preventing spontaneous combustion of the upgraded coal 11. Meanwhile, when the heat treatment temperature is below 40° C., the time required for the deactivation processing is too long and production efficiency is deteriorated. Accordingly, these cases are not preferable.

Second Embodiment

Figure 3:
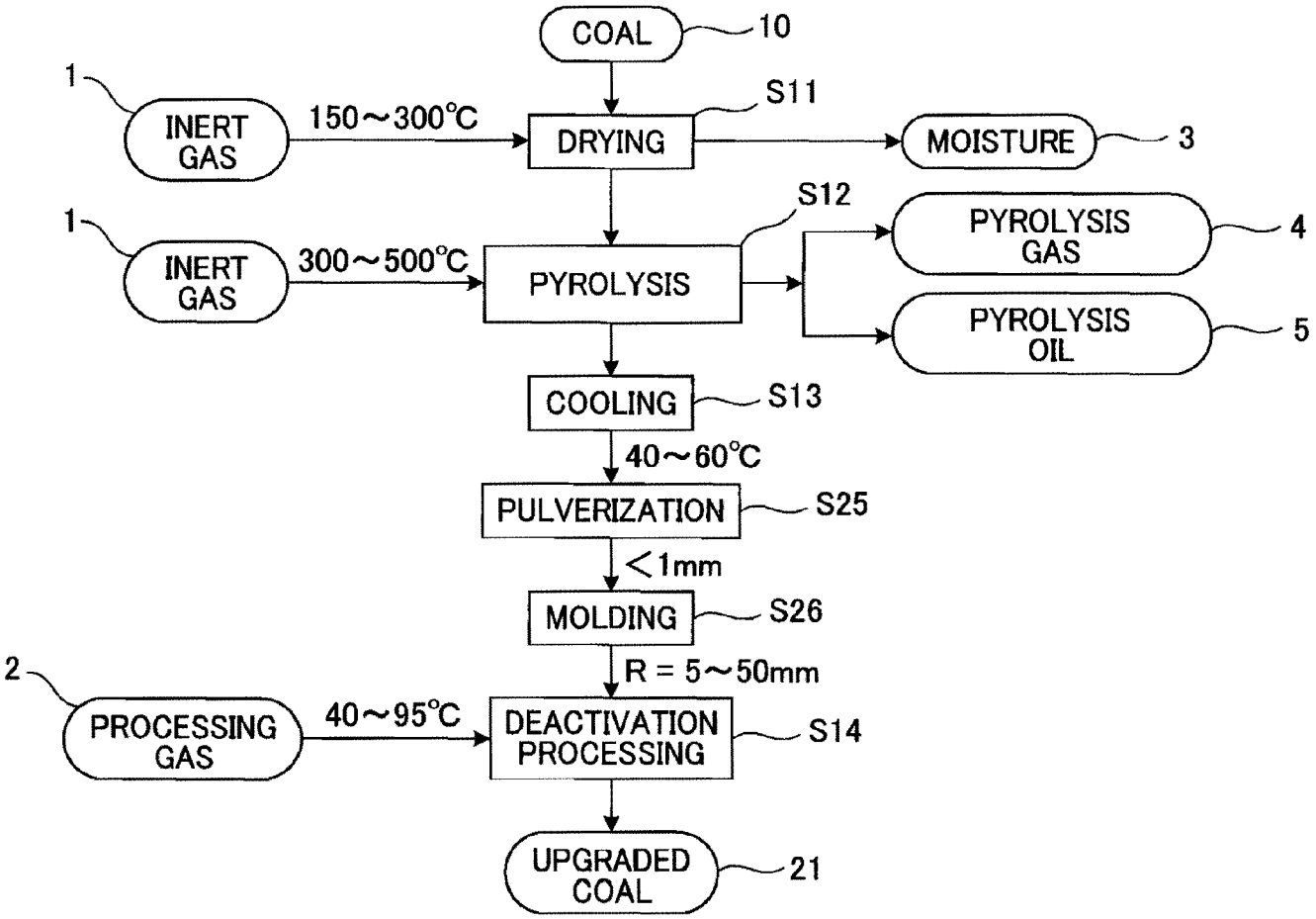
FIG. 3 is a flow diagram of a second embodiment of a coal upgrading method using the coal deactivation processing method of the present invention.

A second embodiment of a coal upgrading method using the coal deactivation processing method of the present invention is described based on FIG. 3. Note that the same parts as those of the aforementioned embodiment are denoted by the same reference numerals as those used in the description of the aforementioned embodiment and description overlapping the description of the aforementioned embodiment is omitted.

As shown in FIG. 3, the coal 10 is subjected to the drying step S11, the pyrolysis step S12, and the cooling step S13 as in the aforementioned first embodiment, and is then pulverized by a pulverizer or the like in such a way that a diameter of each of particles of the coal 10 is equal to or smaller than a specific diameter (for example, 1 mm) (pulverization step S25). Thereafter, the coal 10 is compression-molded into a briquette shape by a molding machine such as a briquetter in such a way that the compression-molded coal 10*a* has a surface area equivalent sphere diameter R, which is expressed by formula (1) shown below, of a specific size (5 mm to 50 mm (preferably, 15 mm to 30 mm)) (molding step S26).

$$R=6\times(V/A) \quad (1)$$

where V represents a coal particle volume and A represents a coal particle external surface area.

After the coal 10 is molded into the briquette shape as described above, the deactivation processing step S14 is performed on the coal 10 as in the aforementioned first embodiment and upgraded coal 21 is thus obtained.

In this case, since the coal 10 is molded into the briquette shape having the surface area equivalent sphere diameter R of the specific size (5 mm to 50 mm (preferably, 15 mm to 30 mm)), variation in areas of the particles are smaller and there is hardly no variation in the oxygen adsorption amount per unit time (oxygen adsorption rate) in each of the briquettes. Moreover, the oxygen adsorption amounts per unit time of the respective briquettes (oxygen adsorption rates) are substantially the same.

Hence, the briquettes can be evenly subjected to the deactivation processing and, in addition, the deactivation processing can be performed substantially uniformly with variations among the briquettes being eliminated.

Accordingly, in the coal deactivation processing method of the embodiment, the effects similar to those in the aforementioned first embodiment can be obtained as a matter of course and the upgraded coal 11 subjected to the deactivation processing more uniformly than in the aforementioned first embodiment can be easily obtained.

Note that, when the surface area equivalent sphere diameter R of the coal 10 compression-molded into the briquette shape exceeds 50 mm, an oxygen adsorption rate per unit mass is too slow and the time required for the deactivation processing is too long. Meanwhile, when the surface area equivalent sphere diameter R is smaller than 5 mm, molding efficiency is deteriorated. Accordingly, these cases are not preferable.

When the surface area equivalent sphere diameter R is within a range of 15 mm to 30 mm, the heat treatment within the aforementioned temperature range can be easily performed even if air is used as it is as the processing gas 2. Hence, work and a facility required for the deactivation processing can be greatly simplified and this case is thus very preferable.

INDUSTRIAL APPLICABILITY

Since the coal deactivation processing method of the present invention can suppress reduction of the combustion heating value per unit weight of coal while preventing spontaneous combustion of the coal, the coal deactivation processing method can be very useful in the energy industry and the like.

REFERENCE SIGNS LIST

1 INERT GAS
2 PROCESSING GAS
3 MOISTURE
4 PYROLYSIS GAS
5 PYROLYSIS OIL
10 COAL
11, 21 UPGRADED COAL
S11 DRYING STEP
S12 PYROLYSIS STEP
S13 COOLING STEP
S14 DEACTIVATION PROCESSING STEP

S25 PULVERIZATION STEP

S26 MOLDING STEP

The invention claimed is:

1. A coal deactivation processing method comprising:

compression molding pyrolized coal into a briquette shape in such a way that the compression-molded coal has a surface area equivalent sphere diameter R, which is expressed by formula (1), of 15 mm to 30 mm, $$R=6\times(V/A) \quad (1)$$

where V represents a coal particle volume and A represents a coal particle external surface area, and subjecting the pyrolized coal briquette to deactivation processing by contacting with processing gas containing oxygen, said processing gas being air, and said deactivation processing being within a temperature range of 45° C. to 70 ° C.

* * * * *